US005678497A

United States Patent [19]

Goidich

[11] Patent Number: 5,678,497

[45] Date of Patent: Oct. 21, 1997

[54] APPARATUS FOR DISTRIBUTING SECONDARY AIR INTO A LARGE SCALE CIRCULATING FLUIDIZED BED

[75] Inventor: Stephen John Goidich, Palmerton, Pa.

[73] Assignee: Foster Wheeler Energy International, Inc., Clinton, N.J.

[21] Appl. No.: 640,582

[22] Filed: Apr. 30, 1996

[51] Int. Cl.[6] ..... F23G 5/00

[52] U.S. Cl. ..... 110/245; 110/347; 122/4 D

[58] Field of Search ..... 110/245, 347; 122/4 D

[56] References Cited

U.S. PATENT DOCUMENTS 3,865,084 2/1975 De Poister ..... 122/235.13

4,145,178 3/1979 Egnell et al. ..... 431/11

4,421,064 12/1983 Lehtinen ..... 122/15

4,562,795 1/1986 Kraus ..... 122/12

*Primary Examiner*—Henry A. Bennett

*Assistant Examiner*—Pamela A. O'Connor

[57] ABSTRACT

A fluidized bed combustion system in which a partition is disposed in an enclosure to divide the enclosure into two furnace sections for receiving beds of combustible particulate material. Air is introduced into each bed in quantities sufficient to fluidize the material and insufficient to completely combust said material, and additional air is introduced through said partition and into said sections in quantities sufficient to completely combust said material. An equalization port is provided through the partition for equalizing the pressure between the furnace sections.

10 Claims, 3 Drawing Sheets

APPARATUS FOR DISTRIBUTING SECONDARY AIR INTO A LARGE SCALE CIRCULATING FLUIDIZED BED

BACKGROUND OF THE INVENTION

This invention relates to a large scale circulating fluidized bed combustion system, more particularly, to such a system in which a centrally located tubed wall, or partition, having secondary air ports and a pressure equalization port, spans the height and depth of the furnace.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

One type of system utilizes a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases and the solids entrained thereby from the fluidized bed. The solids are separated from the flue gases in the separator and the flue gases are passed to a heat recovery area, while the solids are recycled back to the furnace through a seal pot or seal valve. All of the fuel is combusted and the heat of combustion is absorbed by water/steam-cooled tube surfaces forming the interior boundary of the furnace section and the heat recovery area. The recycling improves the efficiency of the separator, and the resulting increase in the efficient use of sulfur adsorbent and fuel residence times reduces the adsorbent and fuel consumption.

Another method used to decrease pollutants produce by large scale fluidized beds and more particularly, to reduce the emission of nitrous oxides, is to reduce the amount of primary air supplied to the fluidized bed so that it is below the ideal amount for complete combustion. Combustion is then completed by secondary air that is injected above the fluidized bed in sufficient quantities to ensure complete combustion.

The typical approach to designing a large scale fluidized bed employing secondary air to reduce nitrous oxide emissions is to limit the front wall-to-rear wall depth of the furnace to ensure good secondary air penetration. The width is then increased and the fuel, the sorbent, and the fuel recycling points are increased as well. Any increase in depth will also be accompanied by an increase in the distance that the secondary air must travel from the front wall to the rear wall. This increased distance results in inadequate secondary air penetration, incomplete combustion, and diminished capacity to reduce the production of nitrous oxide.

SUMMARY OF THE INVENTION

It is therefore an object of the present invention to provide a large scale fluidized bed combustion system in which the emissions of nitrous oxide is reduced.

It is a further object of the present invention to provide a system of the above type in which the furnace enjoys a relative high front-to-rear depth.

It is a further object of the present invention to provide a system of the above type which utilizes a centrally located partition that spans the width and height of the furnace to increase the heat transfer surfaces within the furnace.

It is a further object of the present invention to provide a system of the above type in which the centrally located wall allows for the delivery of secondary air to the center of the furnace.

It is a still further object of the present invention to provide a system of the above type in which a pressure equalization port is provided in the partition to allow fluid communication between the two portions of the furnace.

Toward the fulfillment of these and other objects, the system of the present invention includes an enclosure defining two furnace sections and a partition that spans the furnace's depth and height. The partition is provided with nozzles to distribute secondary air into the furnace sections and a pressure equalization port to allow fluid communication between the two sections.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
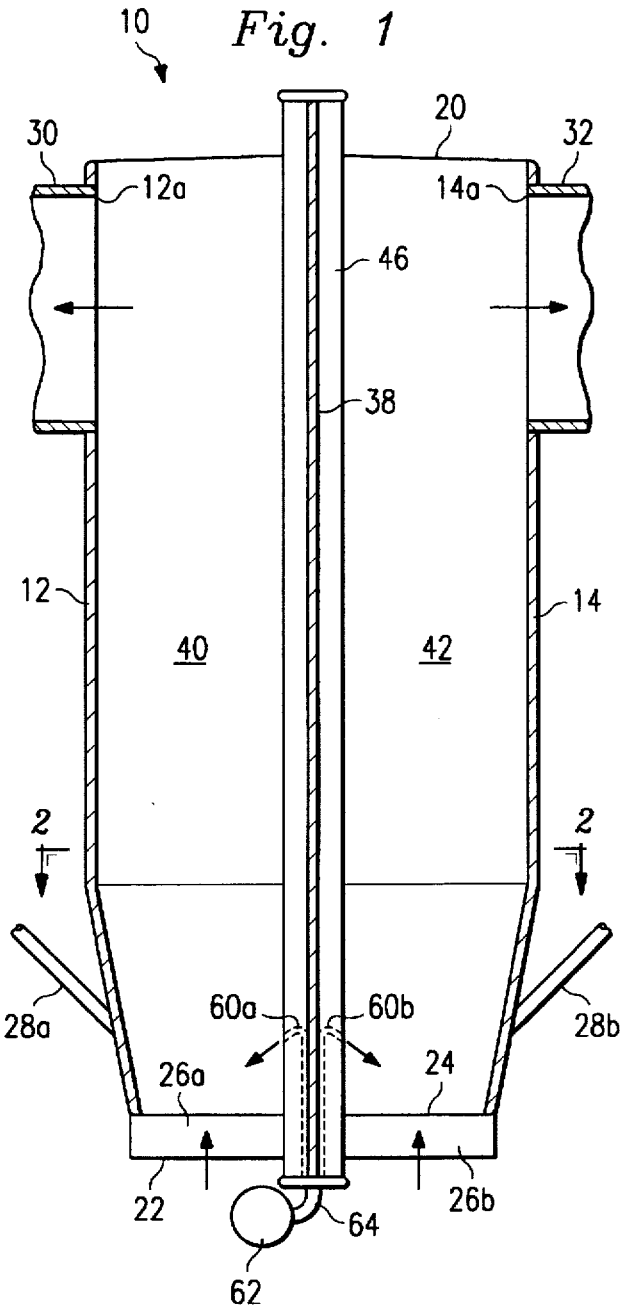
FIG. 1 is a partial-schematic, partial sectional view depicting the system of the present invention.
Figure 2:
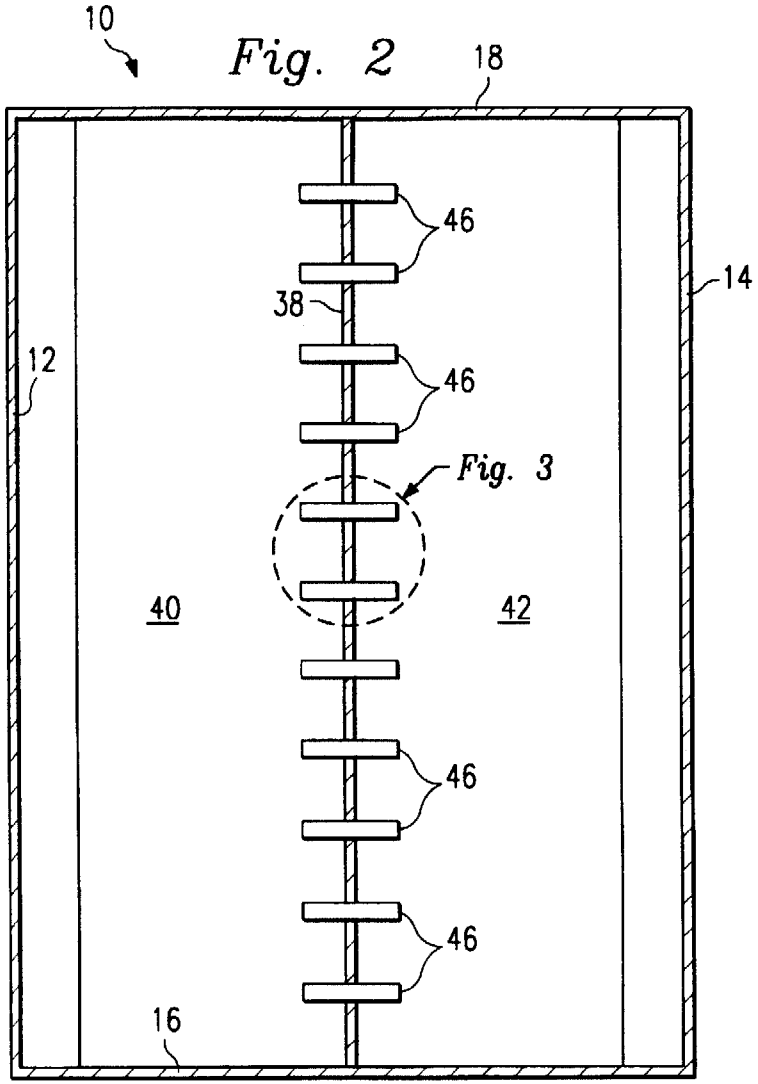
FIG. 2 is an enlarged cross-sectional view taken along the line 2—2 of FIG. 1.
Figure 3:
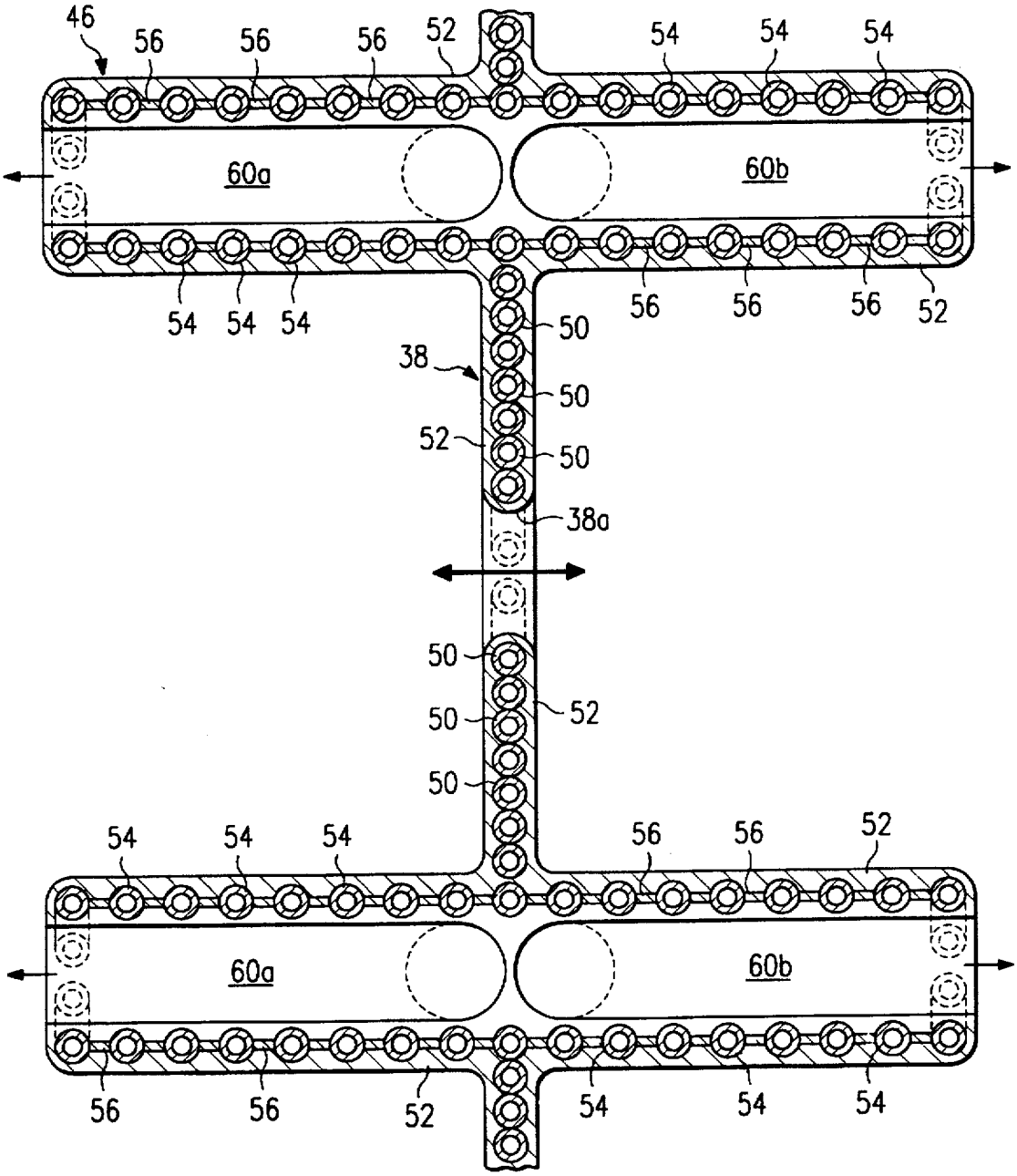
FIG. 3 is an enlarged view of an area of FIG. 2 enclosed within the circle 3.

FIGS. 1–3 depict a preferred embodiment of the fluidized bed combustion system of the present invention used for the generation of steam and including an upright water-cooled enclosure, referred to in general by the reference numeral 10, having a front wall 12, a rear wall 14 and two sidewalls 16 and 18. The upper portion of the enclosed 10 is closed by a roof 20 and the lower portion includes a floor 22.

An air distributor system including a plurality of air distributor nozzles (not shown) of a conventional design are mounted in corresponding openings formed in a plate 24 extending across the lower portion of the enclosure 10. The plate 24 is spaced from the floor 22 to define an air plenum 26, as will be described, which is adapted to receive air from an external source (not shown) and selectively distribute the air through the nozzles into the furnace 10. It is understood that a control device is provided in the external air source to enable the velocity of the air passing therethrough to be controlled.

Two fuel feeders, shown in general by the reference numerals 28*a* and 28*b*, are provided adjacent to the walls 12 and 14, respectively, for introducing particulate material containing fuel into the furnace 10. Since the feeders 28*a* and 28*b* operate in a conventional manner to spread the fuel into the lower portion of the furnace 10 they will not be described in any further detail. It is understood that a particulate sorbent material may also be introduced through the feeders 28*a* and 28*b*, or through other feeders, into the furnace 10 for absorbing the sulfur generated as a result of the combustion of the fuel.

Although not shown in the drawings, it is understood that a fuel recycling system may be provided adjacent the furnace 10 and connected thereto, via ducts 30 and 32 which extend from openings 12*a* and 14*a* provided in the walls 12 and 14, respectively. The recycling system would include a pair of separators adapted to receive flue gases and entrained particles from the ducts 30 and 32, respectively, and disengage the particles from the flue gases in a conventional manner.

A centrally located partition, or wall, referred to in general by reference number 38, is disposed in the enclosure 10, extends from the sidewall 16 to the sidewall 18 and midway between the front wall 12 and the rear wall 14. The wall 38 extends the full height of the enclosure 10 and splits the interior of the enclosure into two mirrored furnace sections 40 and 42. The lower portion of the wall 38 extends below the floor 22 to split the plenum 26 into two sections 26*a* and 26*b*. Openings (not shown) are provided in this lower portion of the wall 38 to allow air communication between sections 26*a* and 26*b*. The furnace section 40 is in fluid communication with the opening 12*a*, the duct 30, the fuel inlet 28*a*, and the air plenum 26*a*; while the furnace section 42 is in fluid communication with the opening 14*a*, the duct 32, the fuel inlet 28*b*, and the air plenum 26*b*.

Extending outwardly from, and perpendicular to, the wall 38 are a plurality of walls 46 that extend in a spaced, parallel relationship from the wall 16 to the wall 18. The walls 46 span the height of the furnace 10 and their widths are less that the distance between the walls 12 and 14.

As shown in FIG. 3, the wall 38 is formed by a plurality of spaced, parallel water tubes 50 extending the entire height of the wall, disposed in an abutting relationship and encased by a refractory material 52. Each wall 46 is hollow and is formed by a plurality of spaced, parallel water tubes 54 aligned in two spaced rows and also enclosed by the refractory material 52, with the adjacent tubes being connected together by a plurality of fins 56 extending between the adjacent tubes.

As shown in FIGS. 1 and 3, a pair of nozzles 60*a* and 60*b* extend upwardly from the beneath the floor 22 (FIG. 1) and vertically into each wall 46. The upper portions of the nozzles 60*a* and 60*b* extend slightly downwardly within their respective walls 46 for reasons to be described.

A plurality of fans 62 (FIG. 1) are provided and are connected, via a corresponding plurality of conduits 64, to a plenum (not shown) for supplying secondary air to the nozzles 60*a* and 60*b*. The air thus passes through the nozzles 60*a* and 60*b* and discharges downwardly through the respective ends of each wall 46 into the furnace sections 40 and 42.

It is understood that a system for circulating fluid, such as water, is provided which system includes the tubes forming the walls 12, 14, 16, and 18 as well as the tubes 50 and 54 forming the walls 38 and 46, respectively.

As shown in FIG. 3, a pressure equalization port 38*a* is formed in the lower portion of the wall 38 above the plate 24 and below the nozzles 60*a* and 60*b* to communicate the furnace sections 40 and 42. This is achieved in any known manner such as by removing the fins between adjacent tubes and bending a few of the tubes so to form the opening.

In operation, fuel is introduced into the furnace sections 40 and 42 through the feeder systems 28*a* and 28*b*. Air from an external source is introduced at a sufficient pressure into the plenums 26*a* and 26*b* extending below furnace sections 40 and 42, respectively, so that it passes through the nozzles disposed in the plate 24 at a sufficient quantity and velocity to fluidize the solids in the furnace sections.

A lightoff burner (not shown), or the like, is provided to ignite the fuel material, and thereafter the fuel material is self-combusted by the heat in the furnace sections 40 and 42. The flue gases pass upwardly through the furnace sections 40 and 42 and entrains, or elutriates, a majority of the solids. The quantity of the air introduced, via the air plenums 26*a* and 26*b*, through the nozzles and into the interior of the furnace sections 40 and 42 is established in accordance with the size of the solids so that a circulating fluidized bed is formed, i.e. the solids are fluidized to an extent that substantial entrainment or elutriation thereof is achieved.

The quantity of air introduced into the furnace sections 40 and 42 through the nozzles in the above manner is less than that required for complete combustion of the fuel particles to reduce the formation of nitrous oxides. Air from the fans 62 is introduced into the nozzles 60*a* and 60*b* and thus discharges into the furnace sections 40 and 42 to supply secondary air in sufficient quantities to complete the combustion, while the pressures in the sections are maintained substantially equal by the port 38*a*.

The saturated flue gases in the upper portion of the furnace section 40 and 42 pass into the ducts 30 and 32 respectively, and into cyclone separators (not shown) respectively connected to the ducts where the solids are separated from the flue gases in a conventional manner. The separated gases are then passed to another section, such as a heat recovery area, of the system for further treatment and the separated solids are preferably recycled back to the furnace sections 40 and 42 in a conventional manner.

Water is circulated through the above-mentioned circulation system including the tubes forming the walls 12, 14, 16, and 18 as well as the tubes 50 of the wall 38 and the tubes 54 of the walls 46 to convert the water to steam by the heat generated in the furnace sections 40 and 42, also in a conventional manner.

The following advantages are achieved by the system of the present invention:

1. The discharge of the secondary air, via the nozzles 60*a* and 60*b*, at spaced locations along the wall 38, which is located near the center of the enclosure 10, enables the front-to-rear depth of the furnace enclosure 10, i.e., the distance between the walls 12 and 14, to be increased.

2. The discharge of the secondary air in the above manner enhances the mixing of the secondary air, the primary air from plenums 26*a* and 26*b* and the fuel particles, resulting in increased combustion of the fuel particles.

Figure 4:
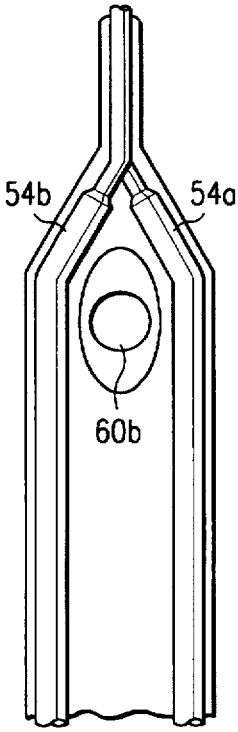
FIGS. 4 and 5 are elevational views depicting the tube arrangement of an alternate embodiment of the present invention.
Figure 5:
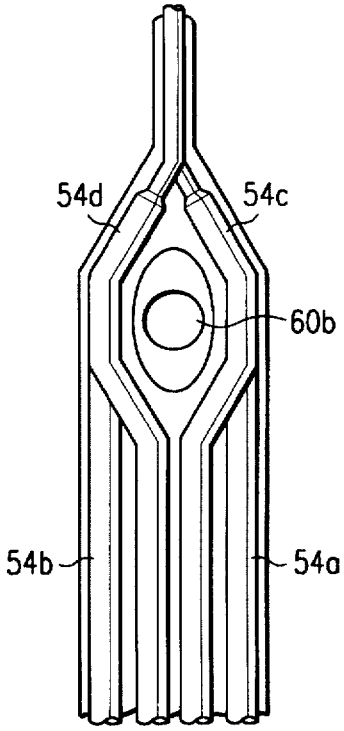
Figure 6:
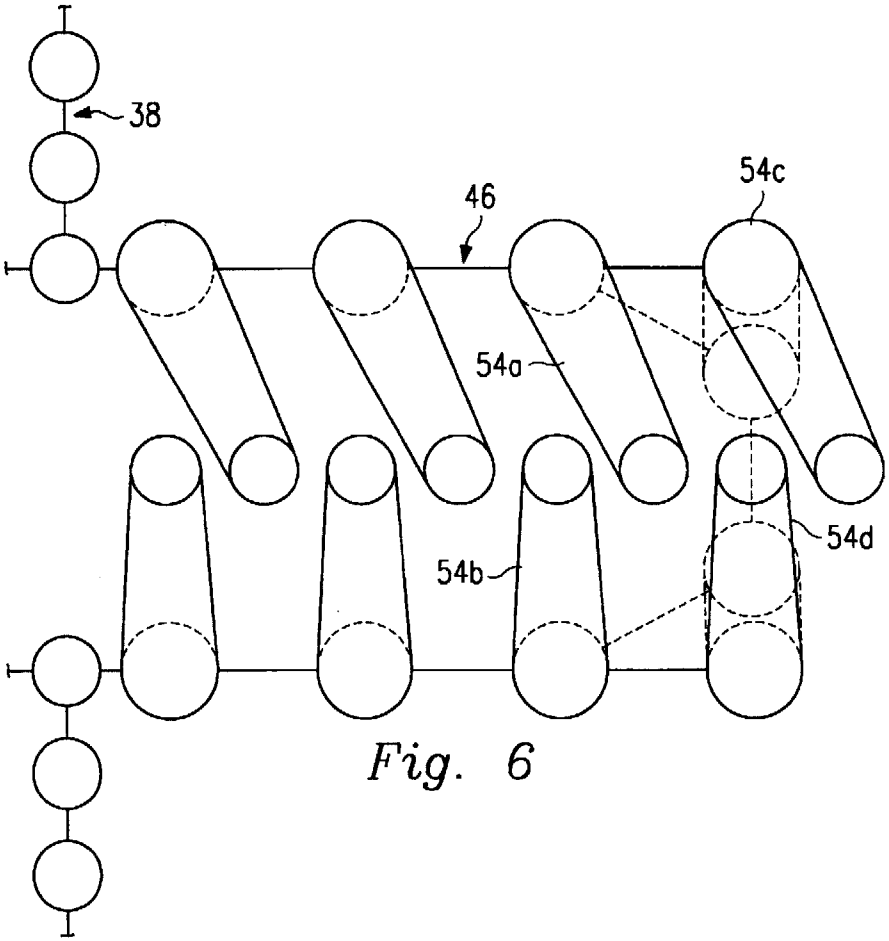
FIG. 6 is a top plan, schematic view of the alternate embodiment of FIGS. 4 and 5.

According to the embodiment of FIGS. 4–6, that portion of each wall 46 that extends above the nozzles 60*a* and 60*b* is not hollow but rather is formed by the tubes 54 extending in an abutting relationship in the same plan to form a unitary wall. Thus, the tubes 54 are configured as shown in FIGS. 4 and 6, with FIG. 4 depicting two adjacent tubes 54*a* and 54*b* for the purposes of example. As shown, the lower end portions of the adjacent tubes 54*a* and 54*b* in the lower portion of the wall 46 are bent outwardly to form a space for receiving a discharge nozzle (60*b*, for example), with the tube 54*a* being bent in one direction and the tube 54*b* in the other. Thus, the tube 54*a* and the corresponding alternating tubes form one wall of the lower, hollow portion of the wall 46 and extend opposite the tube 54*b*; while the remaining alternating tubes form the opposite wall of the latter portion of the wall 46. It is noted that unitary portion the tubes 54 forming the unitary portion of the wall 46 extending above the nozzles 60*a* and 60*b* are of a lesser diameter than the portions of the tubes forming the hollow portion of the wall 46 extending below the nozzles to facilitate the configuration of the latter wall.

FIG. 5 depicts the end of a wall 46 and the configuration of the two end tubes 54 at the latter end, according to the embodiment of FIGS. 4–6. More specifically, the portions of the end tubes forming the lower, hollow portion of each wall, and referred to by the reference numerals 54*c* and 54*d*, respectively, are bent inwardly more than the remaining tubes so as to substantially cover the end of the wall 46. A plurality of fins 60 are provided between the lower portions of the tubes 54*c* and 54*d* as well as between the latter tubes and their adjacent tubes, to render the hollow portions of the wails air 46 air tight except for the openings that receive the end portions of the nozzles 60*a* and 60*b*.

Thus, the embodiment of FIGS. 4–6 enjoys ail of the advantages of the embodiment of FIGS. 1–3 while reducing the heights of the double-walled, hollow walls.

It is understood that other variations can be made in the foregoing without departing from the scope of the present invention. For example, the refractory material 52 does not have to extend the entire height of the wall 38 and the wails 46.

Still other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising an enclosure; a partition disposed in said enclosure and dividing said enclosure into two furnace sections; each of which supports a bed of combustible particulate material; an air distributor system for introducing air into each bed in quantities sufficient to fluidize said material and insufficient to completely combust said material; means for introducing additional air through said partition and into said sections in quantities sufficient to completely combust said material; and means for equalizing the pressure between said sections.

2. The system of claim 1 wherein the enclosure having a front and a rear and said partition extends from the front to the rear of said enclosure and said additional air introducing means provides secondary air at a plurality of locations along said partition and into said sections.

3. The system of claim 1 wherein said equalizing means is comprised of an opening formed in said partition.

4. The system of claim 1 wherein at least a portion of the walls of said enclosure are formed by tubes, and further comprising fluid flow circuit means for passing fluid through said tubes to transfer heat generated in said first and second furnace sections to said fluid.

5. The system of claim 1 wherein said partition is comprised of tubes, and further comprising fluid flow circuit means for passing fluid through said tubes to transfer heat generated in said first and second furnace sections to said fluid.

6. The system of claim 5 wherein said additional air introducing means is disposed within said partition.

7. The system of claim 6 wherein said additional air introducing means is comprised of a plurality of nozzles extending downwardly for discharging into said furnace sections.

8. The system of claim 7 wherein said partition comprises a center wall extending the width of said enclosure and a plurality of additional walls extending perpendicular to said center wall and in a spaced, parallel relationship for the depth of said enclosure.

9. The system of claim 8 wherein said additional walls are hollow to accommodate said nozzles.

10. The system of claim 8 wherein each of said additional walls is formed in part by a plurality of water tubes which extend in a co-planer relationship in a portion of each wall and said water tubes being bent to form two opposite wall portions to accommodate said nozzles.

* * * * *